United States Patent [19]

Rouillard

[11] Patent Number: 4,848,961

[45] Date of Patent: Jul. 18, 1989

[54] CONCRETE SCREED

[76] Inventor: Roger Rouillard, 1627 avenue Notre-Dame, Charlesbourg, Quebec, Canada, G2M 1S6

[21] Appl. No.: 141,986

[22] Filed: Jan. 11, 1988

[30] Foreign Application Priority Data

Jul. 9, 1987 [CA] Canada ..... 541751

[51] Int. Cl.[4] ..... E01C 19/38; E01C 19/22

[52] U.S. Cl. ..... 404/114; 404/97; 425/456; 425/458

[58] Field of Search ..... 404/97, 114, 118, 119, 404/120; 425/456, 458

[56] References Cited

U.S. PATENT DOCUMENTS

| | | | |
|---|---|---|---|
| 867,852 | 10/1907 | Switzer et al. | 404/118 |
| 2,255,343 | 2/1931 | Baily | 404/114 |
| 2,289,248 | 7/1942 | Davis | 404/114 X |
| 2,314,985 | 7/1941 | Jackson | 404/114 |
| 2,746,367 | 5/1956 | Ferguson | 404/114 X |
| 2,897,735 | 8/1959 | Alessio | 404/118 |
| 3,046,856 | 7/1962 | Baxter | 404/118 |
| 3,067,656 | 12/1962 | Gustafson | 404/114 |
| 3,095,789 | 4/1959 | Melvin | 404/114 |
| 3,210,710 | 10/1965 | Amos | 404/114 X |
| 3,311,086 | 3/1967 | Kaier | 404/114 X |
| 4,249,327 | 2/1981 | Allen | 404/114 |
| 4,349,295 | 9/1982 | Morrison | 404/114 |
| 4,359,296 | 11/1982 | Cronkhite | 404/114 |
| 4,386,901 | 6/1983 | Morrison | 404/118 X |
| 4,591,291 | 5/1986 | Owens | 404/114 X |
| 4,650,366 | 3/1987 | Morrison | 404/114 |
| 4,701,071 | 10/1987 | Morrison | 404/114 |

FOREIGN PATENT DOCUMENTS

| | | | |
|---|---|---|---|
| 1202502 | 9/1983 | Canada . | |
| 295603 | 3/1954 | Switzerland | 404/114 |

*Primary Examiner*—Jerome W. Massie, IV
*Assistant Examiner*—John F. Letchford
*Attorney, Agent, or Firm*—Fay, Sharpe, Beall, Fagan, Minnich & McKee

[57] ABSTRACT

The present invention relates to a concrete screeding apparatus, and more particularly to an improved portable and lightweight vibrating concrete screed enabling a workman to use same without the need for rigid forms. The screeding apparatus comprises a generally elongated beam having a horizontal surface and a generally vertical surface. A plurality of vibrators are mounted on the beam. The height of the vertical surface diminishes from the center to the edges so as to increase the amplitude of vibration and, therefore, improve the manoeuvrability of the screed. In addition, the corners formed by the trailing edge and the side edges of the horizontal surface are rounded so as to avoid the penetration of the side edges into the freshly poured concrete.

14 Claims, 1 Drawing Sheet

CONCRETE SCREED

FIELD OF THE INVENTION

The present invention relates to concrete screeding apparatus, and particularly to an improved portable and lightweight vibrating concrete screeds enabling a workman to use same without the need for rigid forms.

DESCRIPTION OF PRIOR ART

For many years, tools for levelling concrete have been developed. Most of those tools are vibrating type screeds which are used in conjunction with rigid forms. Such forms are placed and adjusted to provide the appropriate slope to the slab which is being produced. Such screeds are difficult to use where, for example, a large number of parts or other obstructions protrude from the floor or where forms are not available or adapted to the job being screeded.

Among the prior art, we find U.S. Pat. No. 2,255,343 (BAILY), U.S. Pat. No. 3,095,789 (MELVIN et al), Canadian Pat. No. 1,202,502 (LJUNGKVIST et al) and U.S. Pat. No. 4,349,295 (MORRISSON) which show an apparatus for striking off the surface of concrete or other material during the making of a roadway or similar structures. Said apparatus comprises an elongated beam supported by rigid side forms and are provided with vibrating means.

U.S. Pat. No. 2,314,985 (JACKSON) shows a screed comprising a long beam having a front plate and a rear plate used to smooth off concrete. Said screed further comprises vibrating means.

U.S. Pat. No. 4,386,901 (MORRISON) shows a screed which may be used without rigid forms but which must be supported by at least two operators.

The shortcoming of the above-mentioned screeds is that they need to be supported by rigid side forms or at least two operators. Furthermore, when such a screed is supported by the operators, the slab which results is not completely flat as the edges of the screed plate have the tendency to penetrate into the fresh concrete or to rise slightly above same.

The inventor of the invention described herein is also the inventor of another vibrating screed which may be used without rigid forms. This earlier invention is described in co-pending Canadian Application No: 503,379. Said concrete screed comprises two portions: a first portion is used to level, compact and remove excess concrete, whereas the second portion is used to allow the screed to float on the freshly poured concrete. The main difference between said concrete screed and the one embodying the present invention is that the latter does not need the second portion (floating device).

Furthermore, the front and bottom portion of the screed embodying the present invention are specially shaped to increase the vibration when necessary and therefore to help the compacting, levelling and smoothing of the freshly poured concrete.

OBJECTS OF THE PRESENT INVENTION

A first object of the present invention is to provide an apparatus for handling poured material.

The second object of the present invention is to provide a screed which will facilitate the smoothing off of freshly poured concrete.

A third object of the present invention is to provide a screed which is lightweight and portable.

Another object of the present invention is to provide a screed which is simple and inexpensive to manufacture.

Still another object of the present invention is to provide a screed of improved efficiency and convenience of operation.

A further object of the present invention is to provide a screed enabling a single workman to use same without the need for rigid forms.

The inconveniences of the prior art devices will be overcome through the use of the present invention which is characterized in that the screed is provided with an elongated beam having an horizontal planar surface and a generally vertical surface. Vibrating means are attached to said beam. The upper edges of said vertical surface are specially shaped to increase the amplitude of vibration of the vibrating means. The edges of said horizontal planar surface are rounded to avoid the penetration of said screed into the freshly poured concrete. The thickness of the edges of said horizontal planar surface decreases from the striking edge to said rounded corners.

DESCRIPTION OF THE DRAWINGS

These and other objects of the invention will be more fully and better understood by reference to the accompanying drawings in which.

DETAILED DESCRIPTION OF A PREFERRED EMBODIMENT

Figure 1:
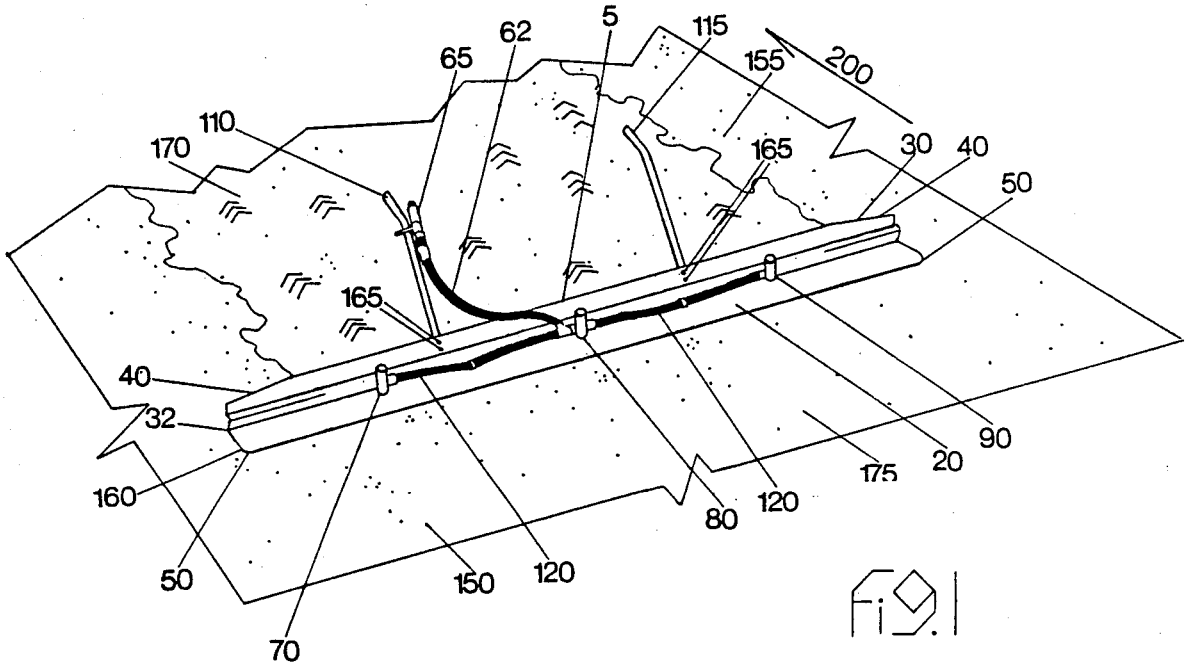
FIG. 1 is a perspective view of a screed embodying the present invention.
Figure 2:
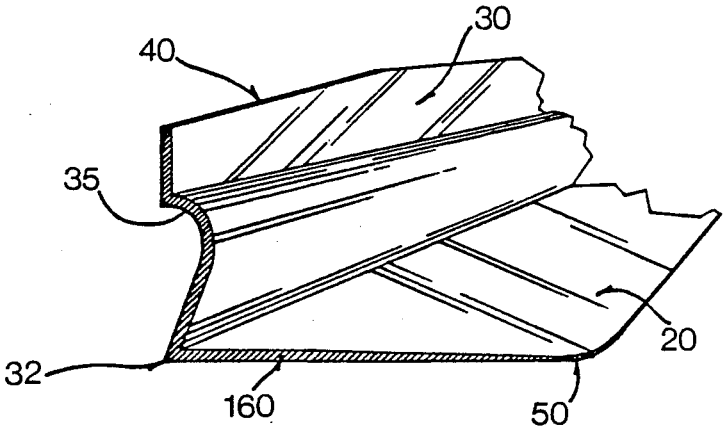
FIG. 2 is a perspective view showing the elongated plate of the screed according to the present invention.

One embodiment of the present invention, comprises a screed 5 having an elongated plate 160 and formed by a generally vertical front surface or plate 30 and an horizontal planar surface 20.

Said front surface 30 is used to push and spread the freshly poured concrete generally referred to as number 170, whereas the said horizontal planar surface is used to press down and smooth the concrete to obtain the surface generally referred as number 175.

The screed 5 slides on two concrete guides 150 and 155, which are formed by pouring and manually levelling same by means of an ordinary wood screed or the like. Then, the concrete required to fill the void between the two guides 150 and 155 is then poured laid using conventional methods such as with a rake and levelled by means of the screed embodying the present invention.

There are three vibrators 70, 80, and 90 placed in a spaced relation on the horizontal planar bottom surface 20 of said screed. It is to be understood that it is possible to install more/or less of those vibrating elements as required.

Said vibrating means 70, 80 and 90 such as air valves are mounted in any suitable manner as by bolting same on said horizontal planar bottom surface 20.

Tubes 120 enable air to be supplied to the vibrators 70, 80 and 90. Said tubes 120 are connected to the supply line 62 to an air source (not shown). Said supply line 62 is provided with an on-off valve 65.

The edges 50 of the horizontal planar bottom surface 20 are rounded so as to prevent the otherwise square corners of same from penetrating into the freshly poured concrete and making unsightly marks.

In order to pull the screed 5 against the freshly poured concrete 170 in the direction of the arrow 200, support means generally referred as number 110 and 115 extend outwardly and are upwardly from said vertical planar side surface 30. Said supports 110 and 115 are preferably adjustable and sufficiently long to suit and accommodate the operator.

Furthermore, the supports 110 and 115 are preferably secured to the screed means of bolts 165 and wing nuts so that the operator may dismantle said support from said screed, so as to facilitate moving of said screed from place to place before and after it is used.

The front surface 30 and the bottom surface 20 may be manufactured from a single piece of metal such as aluminum by means of an extrusion process. Another way to manufacture the longitudinally extending plate generally referred as number 160 would be to weld, bolt or fix together a first vertical plate to a second horizontal plate by any other suitable manner.

Said front surface 30 is preferably curved as shown at 35 in FIG. 3 to improve the spreading of the concrete 170. It is to be understood that other similar shapes of said front surface 35 may be used.

The right level of vibration should be chosen so as to ensure that the entire flat horizontal surface 20 remains in continuous contact with the concrete 150 and 155. Typical values of said vibration would vary between 9500 and 11000 cycles per minute.

The thickness on the planar bottom surface 20 decreases from the striking edge 32 to the rounded ends 50. By so doing, the vibrations of said planar surface 20 is higher near the edges 50, therefore, very little pressure on the supports 110 and 115 is necessary to compact the concrete 170.

Said front surface 30 is provided with upper edges 40 terminating in an outwardly and downwardly inclined formation. By so doing, the amplitude of the vibrations of the sides of said screed are accentuated and it is therefore easier to strike off the concrete.

Screed 5, through experience, has been found to be most useful for purposes of the present invention if its length does not exceed about 8 feet and the overall height is approximately 3½ inches. If the screed has a tendency to sink into the concrete, it is important to pull it more rapidly. Conversely, the operator reduces his speed if he wished to have the screed sink somewhat into the freshly placed concrete. The operator will know with experience the speed of displacement of said screed and the angle he should give to the flat surface 30 relative to the horizontal in order to obtain the best results.

Even if the invention has been described by using a preferred embodiment, it should not be limited to same. It is clear that various additions or modifications and other changes may be effected without departing from the scope of the invention as described and claimed herein.

I claim:

1. A screed for smoothing off freshly poured concrete comprising:

a generally horizontal planar bottom plate of uniform width throughout the length of said screed, said bottom plate having rearward corners;

a generally vertical continuous front plate generally perpendicular to said bottom plate;

said bottom plate and said front plate intersecting and defining a striking edge wherein the thickness of the horizontal planar bottom plate decreases from the intersection of the horizontal planar bottom plate with the rearward surface of the generally vertical continuous front plate to said rearward corners;

vibrating means mounted on said screed; and, at least one support member attached to said screed wherein the height of said front plate diminishes from center to its side edges, the rearward corners of said horizontal planar bottom plate are rounded, and a portion of said generally vertical continuous front plate is curved throughout the length of said screed.

2. A screed according to claim 1 wherein said front plate comprises a longitudinally extending concave portion.

3. A screed according to claim 1 wherein said screed is made of aluminum.

4. A screed according to claim 1 wherein the vibrating means comprises electrical vibrators.

5. A screed according to claim 1 wherein the vibrating means comprise air vibrators.

6. A screed according to claim 1 wherein said vibrating means is defined by three vibrators mounted on said screed.

7. A screed according to claim 1 wherein a second support member is attached to said screed.

8. A screed according to claim 1 wherein said support member is attached to said vertical planar plate by fastening means.

9. A screed according to claim 1 wherein the reduction of the height of said front plate is constant.

10. A screed according to claim 9 wherein said front plate comprises a longitudinally extending concave portion.

11. A screed according to claim 9 wherein said screed is made of aluminum.

12. A screed according to claim 9 wherein the vibrating means comprises electric vibrators.

13. A screed according to claim 9 wherein the vibrating means comprises air vibrators.

14. A screed according to claim 9 wherein the vibrating means is defined by three vibrators mounted on said screed.

* * * * *